US009897389B2

(12) United States Patent
Denoual et al.

(10) Patent No.: US 9,897,389 B2
(45) Date of Patent: Feb. 20, 2018

(54) HEAT EXCHANGER

(71) Applicant: Valeo Systemes Thermiques, Le Mesnil Saint Denis (FR)

(72) Inventors: Christophe Denoual, Noyen sur Sarthe (FR); Alain Pourmarin, La Suze-sur-sarthe (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 223 days.

(21) Appl. No.: 14/375,209

(22) PCT Filed: Jan. 29, 2013

(86) PCT No.: PCT/EP2013/051648

§ 371 (c)(1),
(2) Date: Jul. 29, 2014

(87) PCT Pub. No.: WO2013/113684

PCT Pub. Date: Aug. 8, 2013

(65) Prior Publication Data

US 2015/0000869 A1 Jan. 1, 2015

(30) Foreign Application Priority Data

Jan. 30, 2012 (FR) ..... 12 50839
Jan. 29, 2013 (WO) ..... PCT/EP2013/051648

(51) Int. Cl.
*F28D 9/00* (2006.01)
*F28F 27/02* (2006.01)
(Continued)

(52) U.S. Cl.
CPC ..... *F28D 9/0062* (2013.01); *F28D 9/005* (2013.01); *F28D 9/0056* (2013.01); *F28F 3/08* (2013.01); *F28F 27/02* (2013.01); *F28D 7/0025* (2013.01)

(58) Field of Classification Search
CPC ..... F28D 9/005; F28D 9/0056; F28D 2021/0085; F28D 9/0037; F28D 9/0043;
(Continued)

(56) References Cited

U.S. PATENT DOCUMENTS 2,777,674 A 5/1953 Wakeman
4,002,201 A * 1/1977 Donaldson ..... F28D 1/0333 165/140

(Continued)

FOREIGN PATENT DOCUMENTS

EP 2 175 222 A1 4/2010
WO WO 00/46564 A1 8/2000

(Continued)

OTHER PUBLICATIONS

International Search Report for Application No. PCT/EP2013/051648 dated Mar. 6, 2013, 9 pages.

(Continued)

*Primary Examiner* — Grant Moubry
*Assistant Examiner* — For K Ling
(74) *Attorney, Agent, or Firm* — Howard & Howard Attorneys PLLC

(57) ABSTRACT

The invention relates to a heat exchanger for carrying out a thermal exchange between a first fluid and a second fluid. The heat exchanger includes a plurality of chambers stacked in a longitudinal direction to form a thermal exchange bundle. At least one first chamber suitable for containing the first fluid is defined by a pair of first plates, and at least one second chamber suitable for containing the second fluid is defined by a pair of second plates. The second plates including openings in communication with the second chamber The first plates each include at least two primary openings and at least two secondary openings The two primary openings being in communication with the first (Continued)

chamber, and the two secondary openings being in communication with the openings of the second plates.

15 Claims, 3 Drawing Sheets

(51) Int. Cl.
*F28F 3/08* (2006.01)
*F28D 7/00* (2006.01)

(58) Field of Classification Search
CPC .... F28D 1/0333; F28D 1/0341; F28D 9/0031; F28F 3/086; F28F 2210/04; F28F 2210/08
USPC ..... 165/167
See application file for complete search history.

(56) References Cited

U.S. PATENT DOCUMENTS 4,249,597 A * 2/1981 Carey ..... F28D 9/005 165/166
4,815,534 A 3/1989 Fuerschbach
5,042,577 A 8/1991 Suzumura
5,884,696 A * 3/1999 Loup ..... F28D 1/0333 165/140
6,340,053 B1 * 1/2002 Wu ..... F28D 9/0012 165/140
7,490,483 B2 * 2/2009 Boiarski ..... F25B 7/00 62/476
2004/0089438 A1 * 5/2004 Valensa ..... C01B 3/382 165/4
2007/0261832 A1 * 11/2007 Ware ..... F28D 9/005 165/167
2010/0243200 A1 * 9/2010 Baker, Jr. ..... B60H 1/00342 165/41
2010/0258285 A1 * 10/2010 Yao ..... F28D 9/0037 165/167
2011/0108258 A1 5/2011 Magnier-Cathenod et al.
2012/0247740 A1 * 10/2012 Gertner ..... F28D 9/0006 165/148

FOREIGN PATENT DOCUMENTS

WO WO 2009/117885 A1 10/2009
WO WO 2009/141379 A1 11/2009
WO WO 2010/060657 A1 6/2010

OTHER PUBLICATIONS

English language abstract for WO 2009/141379 extracted from espacenet.com database on Sep. 10, 2014, 2 pages.
English language abstract and machine-assisted English translation for WO 2010/060657 extracted from espacenet.com database on Sep. 10, 2014, 28 pages.

* cited by examiner

HEAT EXCHANGER

RELATED APPLICATIONS

This application is the National Stage of International Patent Application No. PCT/EP2013/051648, filed on Jan. 29, 2013, which claims priority to and all the advantages of French Patent Application No. FR 12/50839, filed on Jan. 30, 2012, the content of which is incorporated herein by reference.

The field of the invention is that of heat exchangers used in a motor vehicle. More particularly, the invention relates to an exchanger between a refrigerant and a heat-transfer fluid, in order to cool said heat-transfer fluid.

A heat exchanger used in a motor vehicle generally comprises a plurality of chambers stacked in a longitudinal direction to form a heat exchange core. More precisely, of these chambers, the first fluid is intended to flow through a plurality of first chambers, while the second fluid is intended to flow through a plurality of second chambers. The assembly of the first and second chambers thus forms the heat exchange core, that is to say a region of the heat exchanger in which the fluids are brought close to one another in order to promote the transfer of calories from one fluid to the other.

In order to delimit these chambers, it is already known to stack the plates so that the first chambers, which are capable of containing the first fluid, are each delimited by a pair of first plates, and the second chambers, which are capable of containing the second fluid, are each delimited by a pair of second plates. Among these plates, there is generally one circulation plate and two cover plates. Each of the circulation plates, interposed between two cover plates, is primarily pierced in the centre thereof in order to accommodate at least one chamber, preferably two chambers. Each of the chambers of the exchanger are thus delimited axially by the piercing in the circulation plate which is associated therewith and longitudinally by the two cover plates surrounding said circulation plate.

In addition, it is already known to make openings in the first and second plates, at the ends thereof located on either side of the chamber that they delimit. Each plate thus comprises two "primary" openings in communication with the corresponding chamber, for circulating the corresponding fluid inside said chamber, as well as two "secondary" openings. The secondary openings in the first plates are intended to be in communication with the secondary openings in the second plates, and vice versa.

When manufacturing the exchanger, the first and second plates are stacked one on top of the other in the longitudinal direction. For this purpose, it is known to solder these plates to one another in a soldering process.

However, owing to the large number of first and second plates, the number of solder joints is necessarily high, thereby causing a risk of leakage.

The problem addressed by the invention is that of reducing the number of solder joints, while promoting satisfactory heat exchange between the heat-transfer fluid and the refrigerant.

A further problem addressed by the invention is that of reducing the weight and cost of a heat exchanger, in terms of manufacture.

For this purpose, according to the invention, the heat exchanger for producing an exchange of heat between a first fluid and a second fluid, comprising a plurality of chambers stacked in a longitudinal direction to form a heat exchange core, at least one first chamber capable of containing the first fluid being delimited by a pair of first plates, at least one second chamber capable of containing the second fluid being delimited by a pair of second plates, the second plates each comprising two openings in communication with the second chamber, is distinctive in that the first plates each comprise at least two primary openings and at least two secondary openings, the two primary openings being in communication with the first chamber and the two secondary openings being in communication with the openings in the second plates.

Thus, owing to the present invention, the number of plates required for the delimitation, both axial and longitudinal, is reduced. Indeed, in order to delimit for example a first chamber, it is sufficient to solder only one pair of first plates together, while the previous configurations required at least three plates for this (one circulation plate and two cover plates). Likewise for delimiting a first chamber and then a second chamber, the invention allows the number of plates required to be limited to four (one pair of first plates and one pair of second plates), while the previous configurations required at least five plates for this (two circulation plates and three alternately stacked cover plates). By reducing the number of plates, the invention therefore also allows the number of solder joints between the plates to be reduced, and therefore limits the risks of leakage in the heat exchange core.

It will be noted that, since the chambers are delimited longitudinally, the present invention allows an entirely satisfactory exchange of heat between the heat-transfer fluid and the refrigerant when they flow through said chambers.

It will also be noted that, to the extent that the present invention allows the number of plates required to be reduced, said invention also allows the weight as well as the cost of the heat exchanger to be reduced, in terms of manufacture.

In order to limit the number of openings required for the assembly of the plates, the second plates may each comprise only two openings. In such a case, these second plates do not have an opening in communication with the first chamber.

Preferably, the first plates are separate from the second plates, thereby allowing the chambers delimited by these plates to be distinguished, some of the chambers being capable of containing the first fluid, while the rest of the chambers are capable of containing the second fluid. In addition, the heat exchange core thus produced is modular.

With respect to the first plates, the primary and secondary openings therein may be made at two respective longitudinal ends (5A, 5B) thereof, thereby allowing the chambers to be made in the centre of these plates.

With respect to the second plates, the openings therein are advantageously made at one longitudinal end thereof.

Since the second plates comprise fewer openings than the first plates for the purpose of assembling the heat exchange core, it may be provided that the length of the first plates is greater than that of the second plates.

Preferably, one of the first plates is joined to one of the second plates. Thus, apart from the solder joint which mechanically connects said directly adjacent plates, air is prevented from passing between said plates, thereby allowing air/fluid exchanges to be eliminated.

Moreover, each plate may comprise a deformation delimited at its periphery by an edge, the base of the deformation extending in a separate plane from that in which the peripheral edge extends, so as to delimit the corresponding chamber at least in part. In this case, the deformation may comprise a groove arranged so as to divide the corresponding chamber in order to form a circuit for circulating the fluid in the shape of a U.

In addition, all the chambers may be arranged so as to delimit a circuit for circulating the fluid in the shape of a U, a first circuit in the shape of a U being reversed relative to a second circuit in the shape of a U.

Advantageously, a disruptor is arranged inside at least one chamber. This disruptor is used to disrupt the flow of the fluids in order to maximise the exchange of heat between said fluids.

Likewise, in order to promote the exchange of heat between the fluids, the first chambers capable of containing the first fluid and the second chambers capable of containing the second fluid may be stacked alternately in the above-mentioned longitudinal direction.

In order to feed the first fluid into each of the first chambers capable of containing the first fluid, said chambers are arranged so as to communicate with a coupling device capable of bringing said first chambers into communication with an external circuit.

In order to feed the second fluid into each of the second chambers capable of containing the second fluid, said chambers are arranged so as to communicate with a connecting device arranged at an end of the core in the longitudinal direction.

The present invention also relates to a heat exchange assembly comprising a heat exchanger according to any of the above-described embodiments, and to an expansion member which is rigidly connected to the heat exchanger.

In this assembly, the expansion member may comprise a solenoid valve.

The present invention also relates to a thermal conditioning system comprising a refrigerant circuit and a heat-transfer fluid circuit, a heat exchanger according to any of the above-described embodiments being installed at the point at which said circuits converge.

The figures of the accompanying drawings will aid understanding of how the invention can be implemented. In the drawings, like reference numerals denote similar technical elements.

Figure 1:
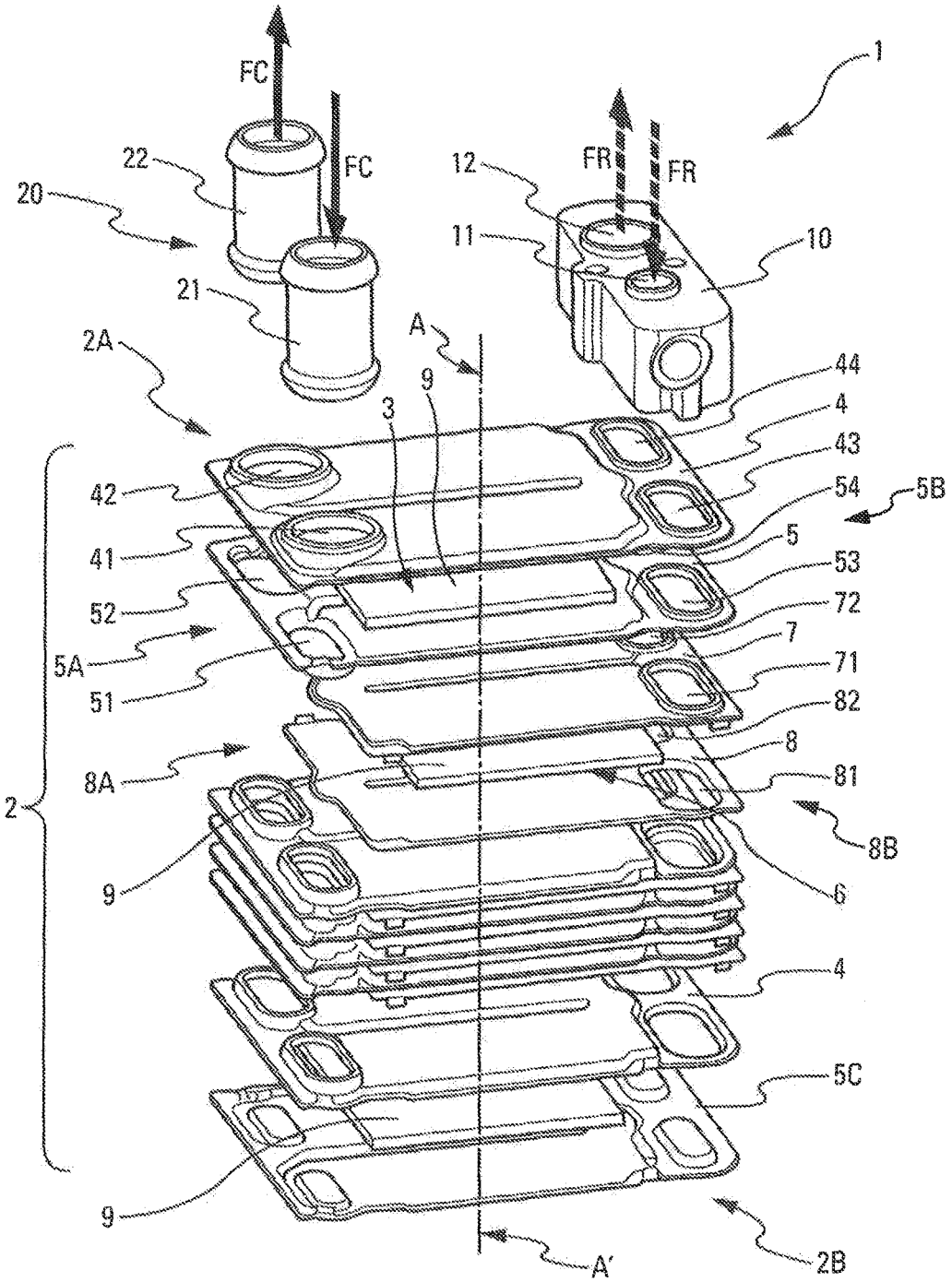
FIG. 1 is an exploded perspective view of a heat exchanger according to the invention.

FIG. 1 shows an embodiment of the heat exchanger 1 according to the invention. This heat exchanger is intended to implement a transfer of heat between a first fluid and a second fluid. According to an embodiment, the first fluid may be a liquid, for example a heat-transfer fluid such as glycol water, while the second fluid may be gaseous, two-phase or liquid.

In the embodiment in FIG. 1, the heat exchanger is more particularly intended to produce an exchange of heat between a refrigerant FR, for example carbon dioxide, R134a or HFO1234YF, and a heat-transfer fluid FC such as water supplemented with glycol.

The heat exchanger 1 comprises a plurality of chambers 3 and 6 stacked in a longitudinal direction A-A' to form a heat exchange core 2 between a first end 2A and a second end 2B of said core 2, the second end 2B being opposite the first end 2A relative to the heat exchange core 2. The first fluid FC is intended to flow through some of the chambers 3, which can be called "first chambers", and the second fluid FR is intended to flow through the rest of the chambers 6, which can be called "second chambers".

According to an embodiment, the heat exchanger 1 comprises alternating first chambers 3 and second chambers 6.

The assembly of the first chambers 3 and the second chambers 6 forms the heat exchange core 2, that is to say a region of the heat exchanger 1 in which the fluids FC and FR are brought closer to each other to promote the transfer of calories from one to the other.

Each of the first chambers 3 is delimited by a pair of first plates 4 and 5. Likewise, each of the second chambers 6 is delimited by a pair of second plates 7 and 8. For this purpose, as can be seen from FIG. 2, a first plate 5 of the pair of first plates 4 and 5 comprises a deformation 55 delimited by a peripheral edge 56, the base of the deformation 55 extending in a separate plane from that in which the peripheral edge 56 extends. The other first plate 4 of the pair of first plates 4 and 5 (not shown) comprises a deformation similar to the deformation 55. The chamber 3 is thus delimited on each side by the deformations made in the first plates 4 and 5.

The same applies to the second plates 7 and 8. Therefore, as can be seen from FIG. 3, a second plate 8 of the pair of second plates 7 and 8 comprises a deformation 83 delimited by a peripheral edge 84, the base of the deformation 83 extending in a separate plane from that in which the peripheral edge 84 extends. The other second plate 8 of the pair of second plates 7 and 8 (not shown) comprises a deformation similar to the deformation 83. The chamber 6 is thus delimited on each side by the deformations made in the second plates 7 and 8 of the same pair.

Figure 2:
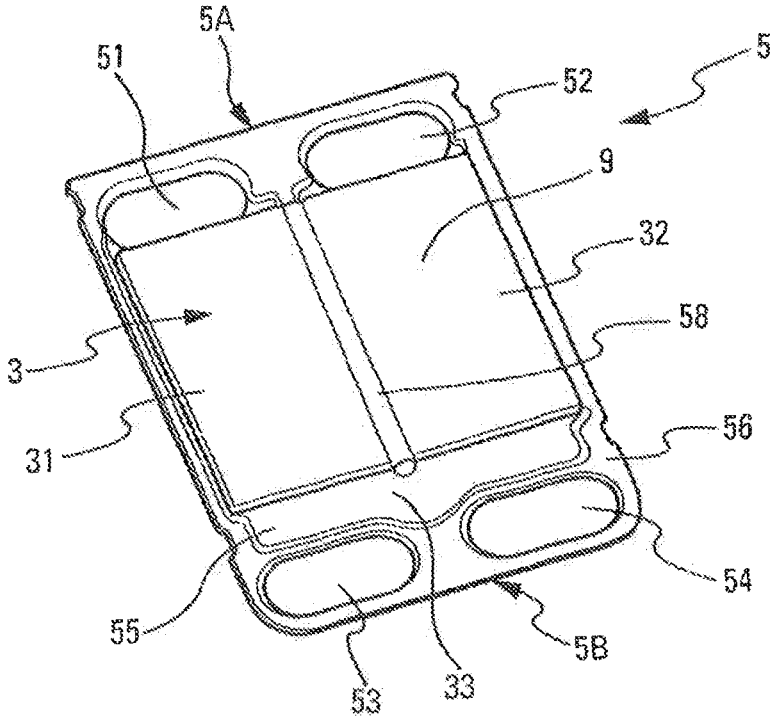
FIG. 2 is a perspective view of one of the primary plates of the exchanger from FIG. 1, associated with two primary chambers.

Moreover, the deformation of each first plate, such as the first plate 5 in FIG. 2, comprises a groove 58 arranged in the centre of said deformation 55 so as to divide the first chamber 3. This groove 58 does not, however, extend along the entirety of the deformation 55, thereby allowing two deformed portions 31 and 32 to be made in the first chamber 3 which are separated by the groove 58 and which communicate with one another by means of the third deformed portion 33. A circuit for circulating the fluid in the shape of a U is thus formed by the portions 31 to 33 of the first chamber 3.

Similarly, in each second plate, such as the second plate 8, the deformation 83 is provided with a groove 85 arranged so as to delimit two deformed portions 61 and 62 which are separated by said groove 85 and which communicate with one another by means of a third deformed portion 63. A circuit for circulating the fluid in the shape of a U is thus formed by the portions 61 to 63 of the second chamber 6.

Figure 4:
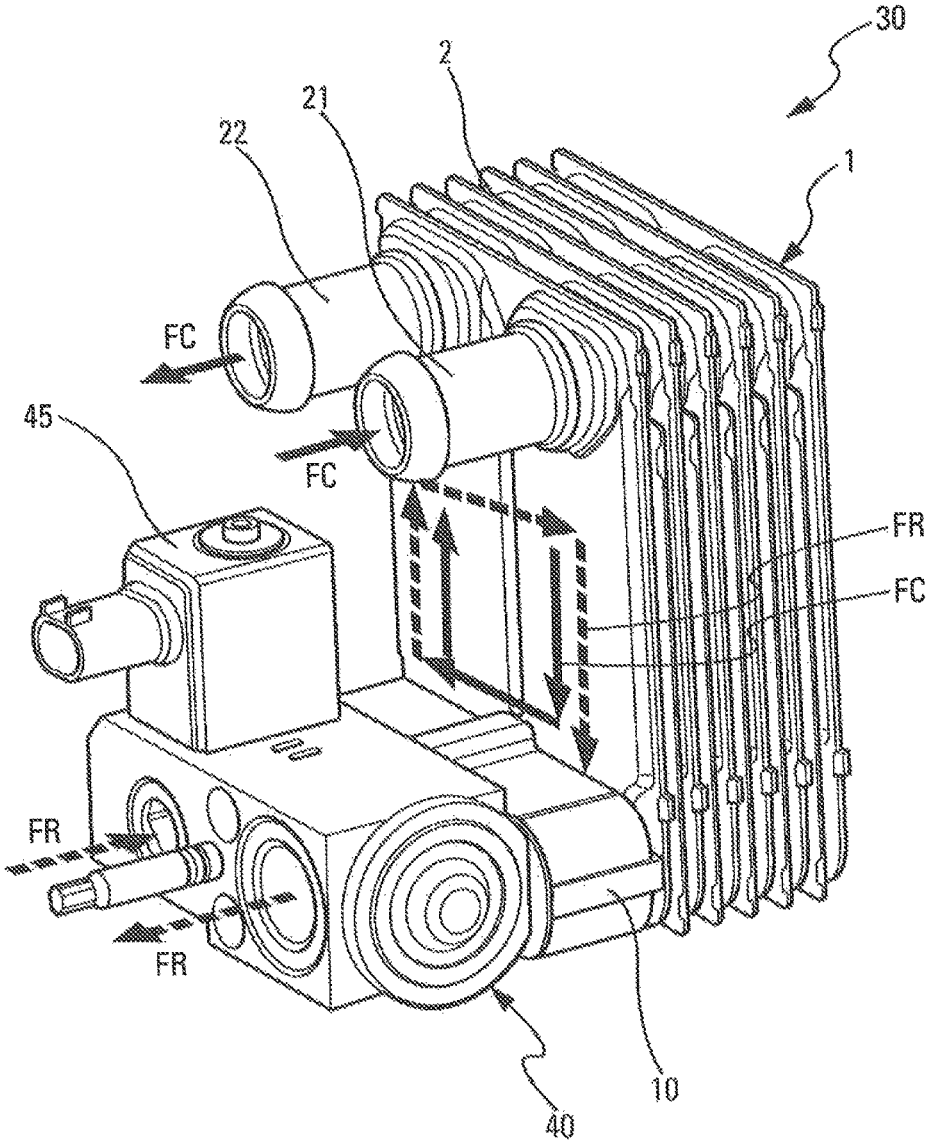
FIG. 4 is a perspective view of a heat exchange assembly comprising the heat exchanger from FIG. 1.

As shown in FIG. 1, since each of the chambers 3 and 6 of the core 2 are arranged so as to delimit a fluid circuit in the shape of a U, said chambers 3 and 6 are arranged relative to one another such that the circuit in the shape of a U of each first chamber 3 is reversed relative to the circuit in the shape of a U of each second chamber 6. As shown in FIG. 4, the fluids FC and FR can thus circulate in a U shape in the first and second chambers respectively in the same direction, so that the circulation of one of the fluids is co-current with the other of the fluids. However, it is possible, by reversing the direction of circulation of one of the fluids FC or FR compared with the embodiment in FIG. 4, for the fluids FC and FR to circulate in opposite directions, so that the circulation of one of the fluids is counter-current with the other of the fluids, thereby allowing the exchanges of heat therebetween to be promoted.

In this embodiment, a disruptor 9 is housed in the volume delimited by each first chamber 3 and each second chamber 6, the function of which disruptor is to disrupt the circulation of the flow of the fluid inside the corresponding chamber to promote the exchange of heat. In one embodiment, this disruptor 9 is a corrugated metal sheet.

The first plates 4 and 5 each comprise two primary openings 41, 42 and 51, 52 and two secondary openings 43, 44 and 53, 54. The second plates are each provided with only two openings 71, 72 and 81, 82 capable of extending from the side of the secondary openings in the first plates.

The openings in the first plate 5 are, as seen in FIG. 2, arranged in pairs at each of the two longitudinal ends 5A and 5B of said first plate 5. The pair of primary openings 51, 52 is thus arranged on the side 5A intended to communicate with the coupling device 20 so that said openings are in communication with the first chamber 3. The pair of secondary openings 53, 54 is arranged on the side 5B via which said secondary openings can communicate with the openings in the second plates.

Figure 3:
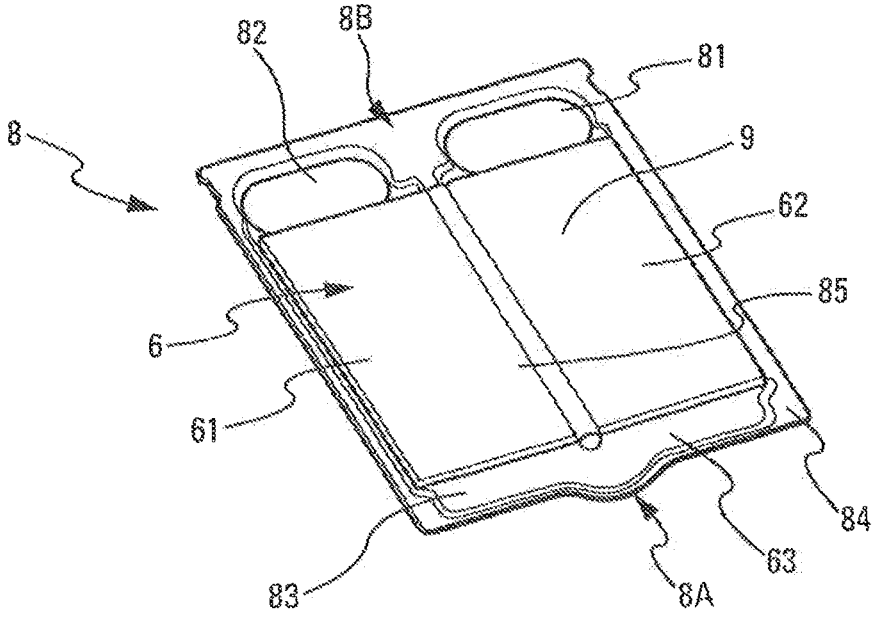
FIG. 3 is a perspective view of one of the secondary plates of the exchanger from FIG. 1, associated with two secondary chambers.

The pair of openings 81, 82 in the second plate 8 are, as seen in FIG. 3, arranged at a longitudinal end 8B of said second plate, on the side via which said openings can communicate both with the second chambers 6 and with the secondary openings in the first plates 4 and 5. At the other longitudinal end 8A of the plate 8, however, no openings of any of the above-mentioned types are made, the second plates 7 and 8 being, on the side of this end 8A, shorter than the first plates 4 and 5. It is therefore understood that the second plates 7 and 8 each comprise only two openings.

Moreover, the first and second plates are stacked one on top of the other in the longitudinal direction A-A', so that the primary openings 41, 42 and 51, 52 of all the first plates communicate with one another in said direction A-A'.

Moreover, the first and second plates are stacked one on top of the other in the longitudinal direction A-A', so that the secondary openings in the first and second plates communicate with one another in said direction A-A', as well as with each of the second chambers 6.

Since the first plates are separate from the second plates, they may be stacked by joining the adjacent plates by soldering.

Each chamber 3 or 6 is thus only delimited by two plates, thereby allowing the number of solder joints which are to be produced in order to assemble the heat exchange core 2 to be limited, in order to reduce the risk of leakage and to reduce weight and costs. It is also noted that arranging only two openings in the second plates 7 and 8 allows the dimensions of said plates to be reduced compared with the first plates 4 and 5, and moreover allows the surface area over which solder joints need to be produced to be limited.

In an embodiment of the invention, the primary openings 41, 42 and 51, 52 in the first plates 4 and 5 are delimited by integral pipes which have a height greater than the height of the pipes delimiting the secondary openings 71, 72 and 81, 82. Furthermore, the height of the pipes delimiting the secondary openings 43, 44 and 53, 54 in the first plates 4 and 5 is substantially identical to the height of the pipes delimiting the openings 71, 72 and 81, 82 in the second plates 7 and 8. The pipes of the primary openings 41, 42 and 51, 52 in the first plates 4 and 5 preferably have a height which is substantially equal to double the height of the secondary openings 43, 44 and 53, 54 in the first plates 4 and 5 or of the openings 71, 72 and 81, 82 in the second plates 7 and 8.

From the side of the second end 2B, the last 5C of the first plates 5 is similar to a first plate 5, but has the distinctive feature of being solid. Indeed, and contrary to the first plates 4 and 5, which have at least one opening 41, 42, 43, 44, 51, 52, 53 or 54 at each of the ends thereof allowing the first fluid to circulate, the final first plate 5C does not have such openings.

It is noted that the final first plate 5C may form a base which receives an attachment means, of which the function is to ensure the heat exchanger 1 is mechanically supported relative to an external support for the exchanger, for example the body of a vehicle or a mounting bracket connecting the heat exchanger 1 to the vehicle.

The first chambers 3 are in communication with, or are connected to, an external circuit of the heat exchanger 1 by means of a coupling device 20. The function of said coupling device 20 is to allow the first fluid FC to circulate between at least one of the first chambers 3 of the heat exchanger 1 and the external circuit.

According to the example from FIG. 1, the coupling device 20 is installed at the first longitudinal end 2A of the heat exchanger 1. Said coupling device 20 comprises two pipes 21 and 22, each comprising a reinforcing collar. A bead forming an increased material thickness which is intended to reinforce the solder region between the pipes and the first plate 4 is positioned between the first plate 4 (from the side of the first end 2A of the core 2) and each pipe 21 or 22.

In the heat exchanger according to the invention, the second chambers 6 are brought into communication with a second external circuit, for example a refrigerant circuit, by means of a connecting device 10 arranged at a first end 2A of the core 2. Said connecting device 10 comprises two tubular openings 11 and 12 which are intended to communicate with the second chambers 6 in order to allow the second fluid FR to circulate therein.

A heat exchange assembly 30 according to the present invention is now described. Said assembly comprises the heat exchanger 1 as described above, to which an expansion member 40 which is rigidly connected to the exchanger, more particularly to the connecting device 10, is joined. Advantageously, the connecting device comprises a means for measuring the temperature of the refrigerant, which is, by way of example, a temperature sensor. The expansion member 40 is one of the components which are essential to the operation of the thermodynamic cycle which takes place in the refrigerant circuit with which the heat exchanger 1 cooperates. Said expansion member 40 ensures that the pressure of the refrigerant is reduced before entering the secondary chambers. Such a reduction leads to cooling of the first fluid which circulates in the first chambers.

According to an optional variant of the heat exchange assembly 30, the expansion member 40 is provided with a solenoid valve 45 capable of electrically controlling said expansion member. Therefore, the level of reduction in the pressure exerted by the expansion member 40 may be made dependent on an external control device which acts on the solenoid valve 45.

The present invention may advantageously be implemented in order to produce a thermal conditioning system. Said system may comprise a first refrigerant FR circuit and a second heat-transfer fluid FC circuit, a heat exchanger as described above being installed at the point at which said circuits converge.

The invention claimed is:

1. A heat exchanger (1) for producing an exchange of heat between a first fluid (FC) and a second fluid (FR), the heat exchanger comprising:

a plurality of chambers (3, 6) stacked in a longitudinal direction (A-A') to form a heat exchange core (2), wherein the plurality of chambers (3, 6) comprises at least one first chamber (3) and at least one second chamber (6), wherein the at least one first chamber (3) is capable of containing the first fluid (FC) with the first chamber (3) delimited by a pair of first plates (4, 5), and wherein the at least one second chamber (6) is capable of containing the second fluid (FR) with the second chamber (6) delimited by a pair of second plates (7, 8), wherein each of the first plates (4, 5) have at least two primary openings (41, 42, 51, 52) located at a first longitudinal end (5A) and at least two secondary openings (43, 44, 53, 54) located at a second longitudinal end (5B) opposite the first longitudinal end (5A), with the at least two primary openings (41, 42, 51, 52) located at the first longitudinal end (5A) being in fluid communication with the at least one first chamber (3) and with the at least two secondary openings (43, 44, 53, 54) located at the second longitudinal end (5B) being in fluid communication with the at least one second chamber (6), wherein each of the second plates (7, 8) have only two openings (71, 72, 81, 82) located at a longitudinal end (8B) corresponding to the second longitudinal end (5B) of the first plates (4, 5), with the two openings (71, 72, 81, 82) at the longitudinal end (8B) being in fluid communication with the at least one second chamber (6) and in fluid communication with the at least two secondary openings (43, 44, 53, 54), and with the two openings (71, 72, 81, 82) at the longitudinal end (8B) not being in fluid communication with the at least one first chamber (3).

2. The heat exchanger according to claim 1, wherein the first plates (4, 5) are separate from the second plates (7, 8).

3. The heat exchanger according to claim 1, wherein the openings (71, 72, 81, 82) in the second plates (7, 8) are not in fluid communication with the at least two primary openings (41, 42, 51, 52) located at the first longitudinal end (5A) of the first plates (4, 5).

4. The heat exchanger according to claim 1, wherein a length of the first plates (4, 5) is greater than a length of the second plates (7, 8).

5. The heat exchanger according to claim 1, wherein one of the first plates (4, 5) is joined to one of the second plates (7, 8).

6. The heat exchanger according to claim 1, wherein each plate (4, 5, 7, 8) comprises a deformation (55, 83) delimited at a periphery of the plate (4, 5, 7, 8) by an edge (56, 84), with a base of the deformation (55, 83) extending in a separate plane from that in which the peripheral edge (56) extends, so as to delimit the corresponding chamber (3, 6) at least in part.

7. The heat exchanger according to claim 6, wherein the deformation (55) comprises a groove (58) arranged so as to divide the corresponding chamber (3, 6) in order to form a circuit for circulating the first fluid (FC) and the second fluid (FR) in the shape of a U (31, 32, 33).

8. The heat exchanger according to claim 7, wherein all the chambers (3, 6) are arranged so as to delimit a circuit for circulating the first fluid (FC) and the second fluid (FR) in the shape of a U, a first circuit in the shape of a U (31, 32, 33) being reversed relative to a second circuit in the shape of a U (61, 62, 63).

9. The heat exchanger according to claim 1, wherein a disruptor (9) is arranged inside at least one of the chambers (3, 6).

10. The heat exchanger according to claim 1, wherein the at least one first chamber (3) capable of containing the first fluid (FC) and the at least one second chamber capable of containing the second fluid (FR) are stacked alternately in the longitudinal direction (A).

11. The heat exchanger according to claim 1, wherein the at least one first chamber (3) capable of containing the first fluid (FC) are arranged so as to communicate with a coupling device (20) capable of bringing the at least one first chamber (3) into communication with an external circuit.

12. The heat exchanger according to claim 1, wherein the at least one second chamber (6) capable of containing the second fluid (FR) are arranged so as to communicate with a connecting device (10) arranged at an end (2A) of the core (2) in the longitudinal direction (A-A').

13. A heat exchange assembly (30) comprising the heat exchanger (1) according to claim 1 and an expansion member (40) which is connected to the heat exchanger (1).

14. The heat exchange assembly according to claim 13, wherein the expansion member (40) comprises a solenoid valve (45).

15. A thermal conditioning system comprising a refrigerant (FR) circuit and a heat-transfer fluid (FC) circuit, with the heat exchanger according to claim 1 being installed at the point at which the circuits converge.

* * * * *